US005379555A

United States Patent [19]

Strieb et al.

[11] Patent Number: 5,379,555

[45] Date of Patent: Jan. 10, 1995

[54] TEMPORARY DRAIN COVER

[76] Inventors: Stephen F. Strieb, 9 Partridge Ct., Novato, Calif. 94947; Gerald W. McCall, 57 Ventura St., Vallejo, Calif. 94590

[21] Appl. No.: 924,671

[22] Filed: Aug. 4, 1992

[51] Int. Cl.[6] ..... F04B 5/00; F04D 5/14

[52] U.S. Cl. ..... 52/3; 52/410; 52/169.14; 4/581; 428/198; 428/920

[58] Field of Search ..... 52/3, 244, 791, 309.16, 52/309.17, 410, 169.14; 4/507, 520, 580, 581, 583, 650, 653, 655, DIG. 18; 428/40, 198, 237, 224, 253, 920

[56] References Cited

U.S. PATENT DOCUMENTS

| | | | |
|---|---|---|---|
| 2,742,391 | 4/1956 | Warp | 52/309.16 |
| 3,420,227 | 1/1969 | Voorles | 4/582 |
| 4,747,241 | 5/1988 | Whitman | 52/410 |
| 4,778,544 | 10/1988 | Jones et al. | 428/253 |
| 4,793,116 | 12/1988 | Whitman | 52/410 |
| 4,833,005 | 5/1989 | Klaar et al. | 428/224 |
| 4,894,875 | 1/1990 | Oxley et al. | 4/581 |
| 4,950,526 | 8/1990 | Singleton | 428/198 |
| 5,157,893 | 10/1992 | Benson et al. | 52/791 |
| 5,204,148 | 4/1993 | Alexander et al. | 428/40 |
| 5,251,414 | 10/1993 | Duke | 52/309.16 |

*Primary Examiner*—Carl D. Friedman
*Assistant Examiner*—Winnie Yip
*Attorney, Agent, or Firm*—Harold D. Messner

[57] ABSTRACT

In accordance with the invention, the device is provided for constructing a temporary cover for a drain opening surrounded by a framing surface of horizontal, curved or irregular shape, comprising M sheets of flame and/or chemical resistant materials in broad surface contact defining coextensive top and bottom surfaces, said top and bottom surfaces each including a smooth, non-quilted central section and an outer edge section in integral contact with said central section, said outer edge sections together defining a series of undulations therebetween, weighted chain means inserted within said series of undulations so as to add loft and weight as a function of radial extent whereby sealing pressure of said bottom surface relative to an associated horizontal, slightly curved or irregular attaching surface is surprising strong. Method steps related to use and manufacture are also recited.

20 Claims, 3 Drawing Sheets

TEMPORARY DRAIN COVER

SCOPE OF THE INVENTION

This invention relates to a temporary covers for covering drains, vents and the like and more particularly to a temporary cover that provides sufficient spark arrest, quenching and conduction capability between respective edges of the cover and the drain opening so that any flame front transversely or laterally propagating along and between the supporting surface and the cover is cooled below ignition temperature before reaching the drain or vent opening.

In one aspect, the invention temporarily provides sufficient conformance pressure between the supporting surface and cover even though the cover is disconnectably attached about the drain or vent by gravity. The invention is strong enough to support vehicular traffic but is light weight, capable of quick removal as required, e.g., to allow visual inspection of the drain, vent or the cover, to re-position the cover about the drain or vent, to transfer the cover to a new site, etc.

In yet another aspect, the conforming surface of the cover is provided with a series of undulations (i.e. lofted regions) in which loft and weight have been added at a function of radial extent whereby the sealing pressure relative to associated horizontal, slightly curved or irregular attaching surface is surprising strong. Because of greater total weight adjacent to the periphery, the invention is able to withstand the pressure of wind, foot and vehicular traffic and the like, without unsealing. Formation of the undulations is provided as follows: a continuous leaded chain is sewn interior of and between three sheets of flame resistant and/or chemical resistant materials. In plan view, the sheets are tetragonal in shape in which the weighted chain is constructed to start near the center of the cover, have a middle portion that loops around and about the center defining a series of lofted folds parallel with the perimetric edges of the cover. The end fold terminates adjacent one of such perimetric edges. The transverse or lateral extent of each particular fold in relation with a side-by side neighbor changes as a function of distance from the center of the cover, increasing in transverse and lateral extent as distance from the center increases. The valleys of such folds include seams that resemble furrows of a plowed field. When attached about the drain or vent, peaks of the undulations flattened to increase the amount of sealing area, but the valleys between peaks remain open. Such construction prevents direct radial entry of explosive vapors into the drainage system, but allows water to follow a serpentining entryway interconnecting the valleys of the undulations that winds in tetragonal fashion many times before entering the drain or vent opening.

In still yet another aspect, stowage of the cover of the invention is enhanced because links comprising the imbedded chain are short enough to allow the cover to be folded along a variety of fold lines.

BACKGROUND OF THE INVENTION

Quenching flame fronts after generation, takes many patterns dictated by the type of flame generation and the particular location of the fuel source after ignition of the flame. For example, within oil or chemical refineries, a possible source for fuel has been identified as open water drains. These structures can become contaminated with volatile fluids such as gasoline, diesel fuel and the like unbeknownst to the refinery personnel. As a result during the occasion of use of open flame generating equipment within the refinery in the vicinity of the drains (such as provided by arc welding equipment), safety requires all drain openings be fortified to prevent exterior flame fronts from entering such drains. These take the form of a series of sand bags overlying a grate covering each drain. Each bag is individually filled for each occasion of use and then emptied after the task has been completed. Since each bag contains about 25 pounds of sand, these endeavors have been found to labor intensive, costly and time consuming to achieve. Additionally, the bags can fail during usage, i.e., rips, tears and the like can occur due to foot and vehicular traffic and can also become contaminated with oil, chemicals and the like during usage which may result in their being classified as hazardous waste under State and Federal laws. Also, there is an additional disadvantage of stowage owing to the bulkiness of the bags absent the sand. Sealing on and about the surfaces adjoining the drain opening may be dislodged as bags are shifted to inspection and re-deployment purposes. While the propagation characteristics of flame fronts as well as methods to retard the spread of the vapor evolved ahead of the front, have been studied by others, no one to our knowledge has combined mechanical and material advantages in the manner taught below.

In the present invention, we have found that in the temperature of the propagating flame front in and about water drains in these circumstances even though within 1 degree of fuel ignition (viz., at 999 degrees F. where fuel ignition is 1,000 degrees F.) at the edge of my cover, are quickly quenched because of shape and construction of our cover, viz., we increase loft and weight of the cover about the drain or vent opening using a weighted chain secured within a series of undulations across the surface of the cover. In that way, while the sealing area of the cover relative to the surface about the drain or vent opening is promoted, there is a proportional reduction in the total area defined by the valleys of the undulations. Such reduction substantially decreases the fuel content available to the flame front. Moreover, since the valleys interconnect in serpentine fashion adjacent to the framing surface to be sealed, that framing surface forms a heat sink relative to the flame front. Moreover due to the serpentine nature of the interconnected valleys, temperature differences can be set up along such serpentining valleys. As a result, the efficiency of conventional and conductional heat transfer between the framing surface and any flame front is surprisingly high. Quenching of the flame, results. In addition, the flame resistant nature of the three sheets that sandwich and retain the weighted chain in position about the drain or vent opening, further reduces fuel content in and about our cover. Where our cover has a contact region whose transverse or lateral dimension encompasses at least six (6) undulations about the drain opening, successful usage has occurred.

SUMMARY OF THE INVENTION

In accordance with the invention, a cover is provided having a conforming surface defining a series of undulations (i.e. quilted) in which loft and weight have been added at a function of radial extent whereby sealing pressure relative to associated horizontal, slightly curved or irregular attaching surface is surprising strong. Because of greater total weight adjacent to the periphery, the invention is able to withstand the pressure of wind, foot and vehicular traffic and the like, without unsealing.

Formation of the undulations is provided as follows: a continuous leaded chain is sewn interior of and between three plys of man-made, flame resistant and/or chemical resistant sheets. In plan view, the near end of the continuous chain starts near the center of the cover, its middle portion loops around and along a series of rectangular folds of increasing transverse and lateral extent relative to the near end, such folds including seams that resemble furrows of a plowed field, and a far end terminating adjacent to the periphery of the cover. When attached about the drain or vent, the peaks of the undulations flattened to increase the amount of sealing area, but the valleys between peaks remain open. Such construction prevents direct radial entry of explosive vapors into the drainage system, but allows water to follow a serpentining entryway that winds in rectangular fashion of deceasing transverse and lateral extent about the drain many times before entering the drain or vent opening.

The top ply is of rectangular cross section and is formed of a fire and chemically resistant polymer in which resins of polypropylene and vinyl have been combined with halogens to increase the flame retardancy. Such polymer has the following characteristics: strong flame, fire and petrochemical resistance (compliance with UL flame test code 217, military specification C-20079F and resistance to petrochemical hydrocarbons and substances). The intermediate ply is composed of fiberglass fibers interwoven into a mat having a broad top surfaces in contact with the exterior ply, the former also having similar shape as the latter as well as being provided with flame, fire and petrochemical resistance characteristics associated with glass. Finally, a bottom ply completes the cover. It also consists of a fire and chemically resistant plastic material such as polypropylene and vinyl such as used to form the exterior ply. The exterior and bottom plys are positioned so as to sandwich the intermediate ply with the leaded chain being sewn in position between the top and intermediate plys in full gravity contact with the intermediate ply and thence through the bottom ply to the surface surrounding the drain or vent. Such adjacent surface is usually just below the bottom ply and is often curved, slanted or irregularly shaped due to different circumstances. Inasmuch as the chain is both flexible enough to accurately follow the contour of such surface surrounding the opening as well as being formed of a high density metal such as lead that adds strength, once sealing pressure is established, such seal is difficult to break. The flexible chain (providing the seal mentioned above) also has an extremely low profile. Hence sidewise or vertical force to dislodge the seal must be quite large. If such force is the result of distributed pressure such as that provide by wind or vehicular traffic, such force required to dislodge the seal must be high. But if such force is sufficient and a portion of the hem rides up, then the remaining distributed weight of enclosed chain acts to resist further movement.

Fitting the cover of the invention about the drain or vent is straight-forward and generally takes only seconds. Removal is equally easy. As segments of the cover clear the drain or vent, the cover is folded back upon itself and then stowed. Owing to its weighted perimeter, such cover can be easily refolded to a small package and stowed.

In the manufacture of the cover of the invention, the sizes of drains and vents of several different plants are determined. Then a median value is established associated with providing at least a minimum transverse or lateral dimension wherein at least 10 inches of seal exists between the edge of the drain or vent opening and the edge of the cover. In that way, a variety of uses can be accommodated by a single manufactured cover. The manufacture is easily accomplished due to the fact that the weighted chain can be inserted between the intermediate and bottom plys and the exterior ply then added atop the intermediate ply. Sewing starts near the center of the assembly and proceeds outward in the series of rectangular loops as previously described. That is, after cutting of the exterior, intermediate and bottom sheets in rectangular pieces and assembling the chain between the former two plys, these elements are sewn together in rectangular loops of increasing lateral and transverse extent.

Modifications of the method and apparatus of the invention can also be made. Such modifications can occur by cutting the plys into circular sheets of equal diameter and then assembling and sewing into circular folds resembling a spiral of increasing radial extent.

DESCRIPTION OF A PREFERRED EMBODIMENT OF THE INVENTION

Figure 1:
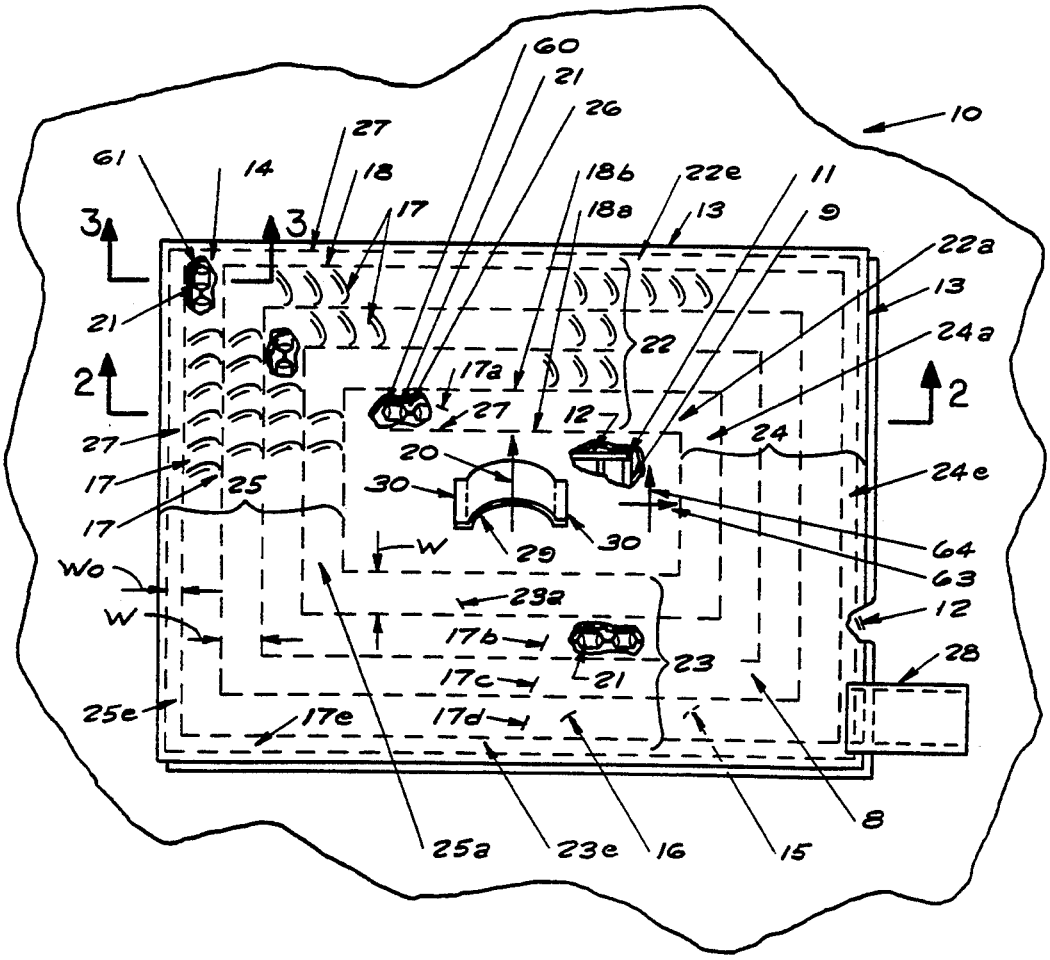
FIG. 1 is a perspective view, partially cutaway, of a cover of the invention positioned atop a drain in which the cover is seen to have perimetric tetragonal edges and is cutaway to show the position of a weighted lead chain at its interior.

Referring to FIG. 1, cover 10 of the present invention is seen positioned atop a drain 9 that includes a grill 11 in contact with a framing surface 12 that can be horizontal, slightly curved or irregular. The framing surface 12 transversely and extends outwardly from the drain 9 a distance of several yards onto which the cover 10 is attached. The cover 10 includes perimetric tetragonal edge 13. While the edge 13 is rectangular or oblong as viewed in plan view, other tetragonal shapes are possible without departing from the teachings for the invention, viz., edges 13 can also be square, rhomboidal or trapezoidal in plan view although a perimetric edge 13 of rectangular or square shape is preferred.

In accordance with the invention, the cover 10 includes a bottom conforming surface 15 and a top surface 16 both of which terminate and hemmed to form the perimetric edge 13 previously mentioned. Such bottom and top surfaces 15, 16 each define a central section generally indicated at 7 and an outer edge section generally indicated at 8. Across the outer edge sections 8 are a series of undulations 17. The series of undulations 17 provide a quilted appearance in plan view and are formed by a series of rectangular seams 18 provided across the bottom and top surfaces 15, 16 within the edge section 8 but do not penetrate the central section 7. Loft and weight have been added at a function of radial extent relative to transverse axis of symmetry 20 using a continuous weighted lead chain 21 sewn within the undulations 17 whereby sealing pressure of the bottom surface 15 relative to the horizontal, slightly curved or irregular framing surface 12 about the drain 9 is surprising strong. Because of greater total weight adjacent to perimetric edge 13 that is provided by the chain 21, note that the cover 10 of the invention is able to withstand the pressure of wind, foot and vehicular traffic and the like, without unsealing.

As shown, the undulations 17 are each include parallel side fold elements 22, 23 and parallel end fold elements 24, 25. The undulations 17 are each rectangularly shaped in plan view. Note in this regard that inner undulations, viz., the side and end elements 22–25 of the undulations **17*a*–17*d*, have transverse and lateral lengths that increase as a function of radial distance from the axis of symmetry 20. However, the outer most undulation, viz., undulation 17*e*, is provided with end elements 24*e*, 25*e* that are equal. Its lateral values associated with side elements 22*e*, 23*e*** are unequal, however.

In more detail, note in FIG. 1 that the inner most undulation **17*a* begins at region 26 with stitch 27 (such region 26 being adjacent to the axis of symmetry 20). Then such undulation 17*a* continues along side element 22*a* between side-by-side seams 18*a*, 18*b*, thence via end element 24*a* and side element 23*a* to second end element 25*a*. Comparing the length of such elements, note that side element 22*a* is shorter than side element 23*a* and end element 24*a* is shorter than the end element 25*a*. The permits the next undulation 17*b* to begin exterior of the inner undulation 17*a*. Such pattern is repeated from undulation 17*b* to undulation 17*c*, from undulation 17*c* to undulation 17*d*, and thence from undulation 17*d* to undulation 17*e*. At the outer most undulation 17*e*, however, the pattern changes. The lengths of the end elements 24*e*, 25*e* are essentially equal (although the lengths of its side elements 22*e*, 23*e* are still unequal). Note also that its width Wo is also much less than the widths W of the undulations 17*a*–17*d* (which are substantially the same). Reason: decreasing the width Wo of the outer most undulation 17*e* assures that the perimetric edge 13 is at a position adjacent of weighted chain 21 so folding of the cover 10 inward from edges 17 toward the axis of symmetry 20 is retarded. The weighted chain 21 is seen to end in region 14 adjacent to hem 27, a part of which includes the perimetric edge 13 previously mentioned. Diagonally opposite to the region 14 is an identification tag 28 attached to the top surface 16. The tag 28 provides space wherein various information in written form may be attached and made a permanent part of the cover 10. Such information can include operational limitations related to use of the cover 10**, owner's name and address, etc.

A strap 29 is shown attached to the top surface 16 within the central section 7. The strap 29 is rectangularly shaped and includes ends 30 that sewn to the top surface 16 in a position that the axis of symmetry 20 bisects the strap 30.

Figure 2:
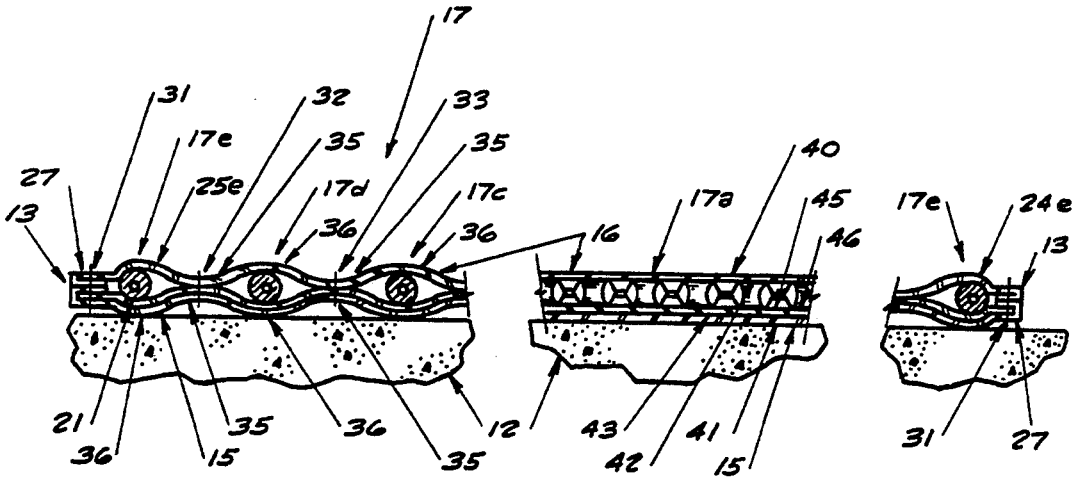
FIGS. 2 and 3 are sections taken along lines 2—2 and 3—3, respectively, illustrating the positions and relationship of the weighted lead chain and fire and petrochemical resistant top, intermediate and bottom sheets that sandwich the lead chain.
Figure 3:
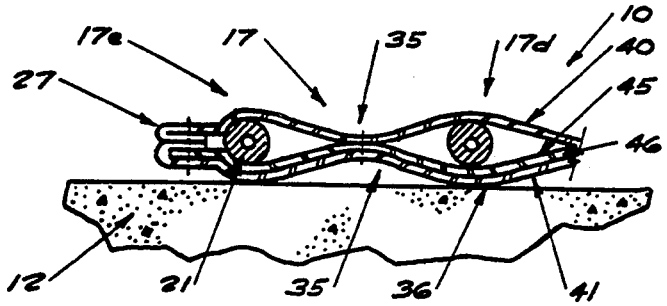

FIGS. 2 and 3 illustrate the undulations 17 in further detail.

In FIG. 2, more remote undulations **17*e*, 17*d*, 17*c* as well as inner undulation 17*a* are shown in section. With regard to undulation 17*e*, note that FIG. 2 shows the relative position of separate end elements 25*e*, 24*e*. They are identical in section wherein hem 27 includes not only perimetric edge 13 but also hem seam 31. Intermediate side-by-side seams 32, 33 are positioned between the adjacent undulations 17*e*, 17*d* and 17*d*, 17*c* and form valleys 35 of such undulations appearing above and below the bottom and top surfaces 15, 16. Peaks 36 are formed between neighboring valleys 35 and appear above and below the bottom and top surfaces 15, 16 of the cover of the invention. Each peak 36 is bisected by a vertical plane through weighted chain 21 sandwiched between the bottom and top surfaces 15, 16. The peaks 36 associated with the bottom surface 15 are in sealing contact with and relative to the framing surface 12 that can be horizontal, slightly curved or irregular in shape as previously mentioned. Such seal is surprising strong because of the weight of the chain 21** at the periphery of the cover is able to withstand the pressure of wind, foot and vehicular traffic and the like, better without unsealing.

The top and bottom surfaces 16, 15 are constructed of identical man-made flame and chemical resistant sheets 40, 41. Top sheet 40 is of rectangular shape in plan view and includes in addition to top surface 16, an interior surface 42. The top sheet 40 is formed of a fire and chemically resistant polymer in which resins of polypropylene and vinyl have been combined with halogens to increase flame retardancy. Such polymer has the following characteristics: strong flame, fire and petrochemical resistance (compliance with UL flame test code 217, military specification C-20079F and resistance to petrochemical hydrocarbons and substances). Bottom sheet 41 is also of rectangular shape sized to match the top sheet 40 cross section and includes in addition to bottom surface 15, an interior surface 43 coextensive of the bottom surface 15. The bottom sheet 41 is likewise formed of a fire and chemically resistant polymer in which resins of polypropylene and vinyl have been combined with halogens to increase flame retardancy. Such polymer has the same characteristics as the top sheet 40, viz., strong flame, fire and petrochemical resistance (compliance with UL flame test code 217, military specification C-20079F and resistance to petrochemical substances including hydrocarbons). An intermediate sheet 45 is sandwiched between the top and bottom sheets 40, 41 and is similar coextensive rectangular shape as top and bottom sheets 40, 41. It is composed of fiberglass fibers 46 interwoven into a mat that provides flame, fire and petrochemical resistance, especially to form a barrier to catch weld stag that burns through the top sheet 40. Such intermediate sheet 45 has sufficient strength to dissipate the heat of the stag and prevent its contact with the bottom sheet 41.

Figure 4:
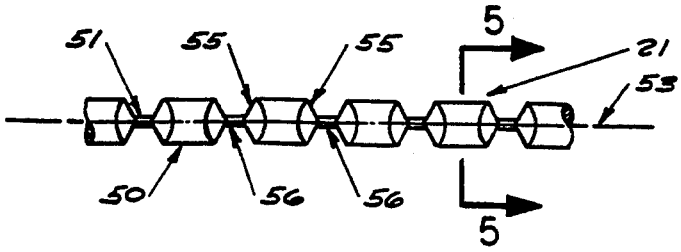
FIG. 4 is detail side elevational view of the lead chain of FIGS. 2 and 3.
Figure 5:
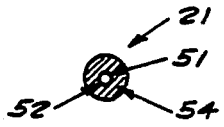
FIG. 5 is a section taken along line 5—5 of FIG. 4.

FIGS. 4 and 5 illustrated the functioning of the weighted chain 21 in more detail.

As shown, weighted chain 21 includes a series of cylindrical links 50 of heavy metal such as lead. The links 50 are attached together by a central cable or line 51, each link 50 including a central opening 52 (see FIG. 5) symmetrical of axis of symmetry 53. The central opening 52 includes a side wall 54 in permanent contact to the central cable 51 and a pair of end walls 55. The end walls 55 slant in opposite directions away from the axis of symmetry 53. Hence, while each link 50 is permanently attached to the central cable 51 over its entire length, the links 50 can flex in any radial direction relative to the axis of symmetry 53 at intersections 56 of neighboring links 50. Such capability permits sufficient flexibility between neighboring links 50, say at intersections 56 of the links 50 to permit gravity to drive the weighted chain 21 strongly against the slightly curved or irregular framing or attaching surface 12 (FIG. 3). Such contact is surprising strong because of the flexibility of the chain 21 is able to place the cover 10 in lowest profile against such framing surface 12 to best withstand the pressure of wind, foot and vehicular traffic and the like, without unsealing. Also such contact quenches flame fronts due to the absence of fuel content and the close proximity of the framing surface 12 to the flame front. Where the cover 10 has a contact region whose transverse or lateral dimension encompasses at least six (6) undulations 17, successful usage has occurred.

In operation, insertion of the weighted chain 21 in and about the cover 10 is straight-forward. As shown in FIG. 3, for example, the top, bottom and intermediate sheets 40, 41, 45, respectively are positioned so as to sandwich the leaded chain 21. The leaded chain 21 is sewn in position between the top sheet 40 and intermediate sheet 46. Since the intermediate sheet 46 is below the top sheet 40, the chain 21 is in full gravity contact with the intermediate sheet 46 and thence through the bottom sheet 41 to the attaching surface 12 surrounding the drain or vent. Such adjacent surface 12 is below the bottom sheet 41 and is often curved, slanted or irregularly shaped due to different circumstances as previously explained. Inasmuch as the chain 21 is both flexible enough to accurately follow the contour of such surface 12 as well as being formed of a high density metal such as lead that adds strength, once sealing pressure is established, such seal is difficult to break. Moreover, such contact quenches flame fronts due to the absence of fuel content in and about the seal and the close proximity of the surface 12 to the flame front as previously explained. The flexible chain 21 (providing the seal mentioned above) also has an extremely low profile. Hence sidewise or vertical force to dislodge the seal must be quite large. If such disruptive force is provided by wind or vehicular traffic, the magnitude of such force required to dislodge the seal must be high. But if such force is sufficient and a portion of the hem 27 rides up, then the remaining distributed weight of enclosed chain 21 acts to resist further movement.

In plan view as illustrated in FIG. 1, note that the insertion of the chain 21 within the cover 10 begins at region 26 where near end 60 of the chain 21 starts near the axis of symmetry 20. The mid portion of the chain 21 loops around and along the series of rectangular undulations 17 of increasing transverse and lateral extent relative to the near end 60. Such undulations 17 includes seams 18 that, in plan view, resemble furrows of a plowed field, The chain 21 includes a more remote end 61. The remote end 61 terminates adjacent to the hem 27 within the region 14.

As shown in FIG. 3, when the cover 10 is attached to the attaching surface 12, the peaks 36 of the undulations 17 flattened to increase the amount of sealing area, but the valleys 35 between sealed peaks 36 remain open. Such construction prevents direct radial entry of explosive vapors into the drainage system, but allows water to follow a serpentining entryway that winds in rectangular fashion of deceasing transverse and lateral extent about the drain many times before entering the drain or vent opening.

MODIFICATION

Figure 6:
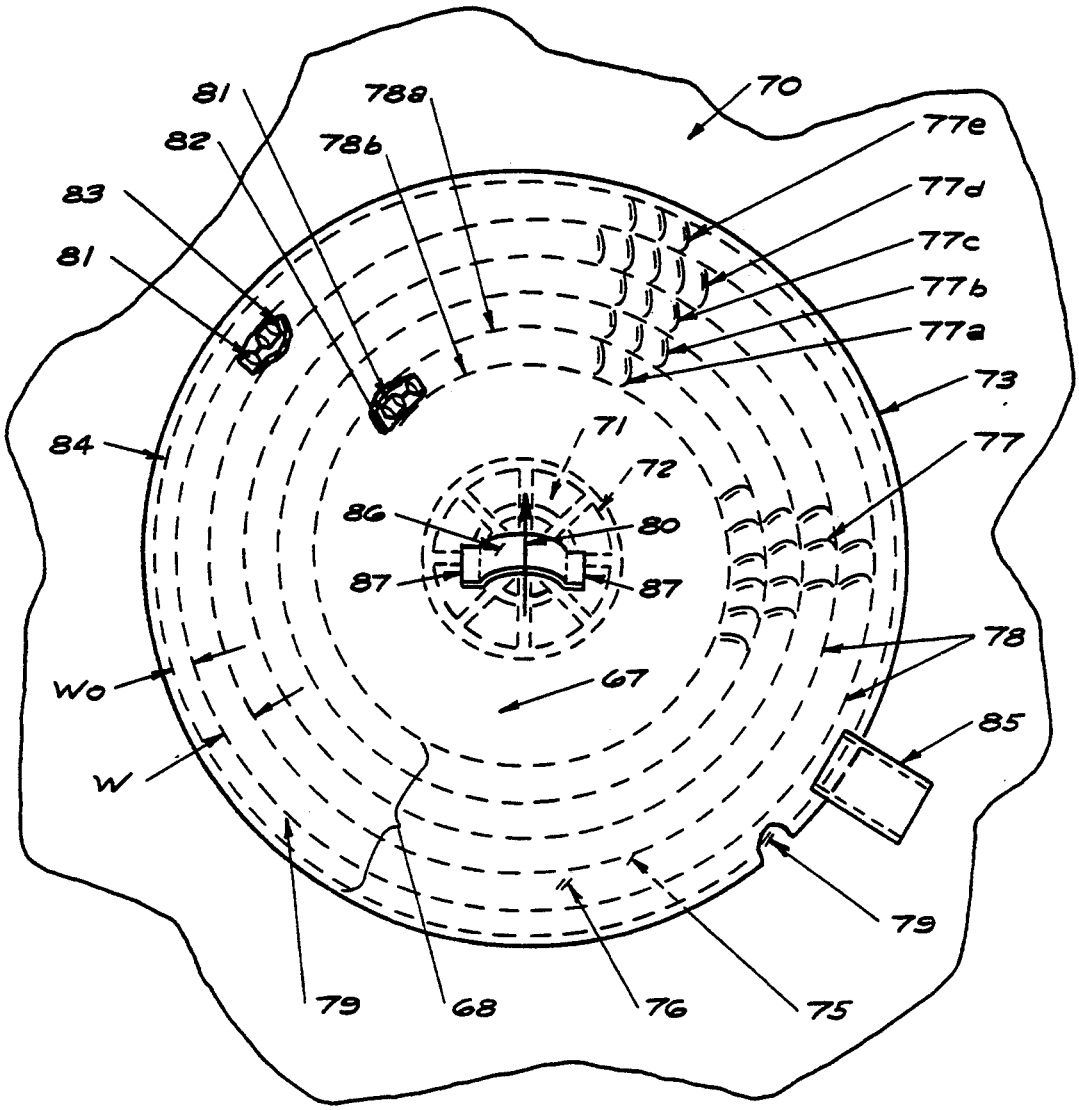
FIG. 6 is a perspective view of a second embodiment of the invention illustrating a cover having an circular circumferencial edge, partially cutaway to the position of the weighted lead chain at its interior.

Referring to FIG. 6, a modified cover 70 of the present invention is seen positioned atop a circular drain 71 that includes a grill 72. The cover 70 is circular and includes a circumferential edge 73.

In accordance with the invention, the cover 70 includes a bottom conforming surface 75 and a top surface 76 both of which terminate and hemmed to form the circumferential edge 73 previously mentioned. Such bottom and top surfaces 75, 76 each define a central section generally indicated at 67 and an outer edge section generally indicated at 68. Across the outer edge sections 68 are a series of circular undulations 77. Such circular undulations 77 are provided with a quilted fashion using a series of circular seams 78 across the bottom and top surfaces 75, 76. Loft and weight have been added at a function of radial extent relative to transverse axis of symmetry 80 using a continuous weighted lead chain 81 that is the same as the chain 21 of FIGS. 1–5. The chain 81 is sewn within the undulations 77 whereby sealing pressure of the bottom surface 75 relative to associated horizontal, slightly curved or irregular attaching surface 79 surrounding the drain 71 is surprising strong. Because of greater total weight adjacent to the circumferential edge 73 by the chain 81, note that the cover 70 of the invention is able to withstand the pressure of wind, foot and vehicular traffic and the like, without unsealing.

As shown, the undulations 77 spiral out from region 82 in increasing radial values measured from the axis of symmetry 80. That is, each undulation 77 includes adjacent seams 78 in which the outer seam say seam **78*a* of the undulation 77*a* has a longer radial extent than inner seam 78*b*. This construction permits the next undulation 77*b* to begin exterior of the inner undulation 77*a*. Such pattern is repeated from undulation 77*b* to undulation 77*c*, from undulation 77*c* to undulation 77*d*, and thence from undulation 77*d* to undulation 77*e*. At the outer most undulation 77*e*, note that its width Wo is much less than the widths W of the undulations 77*a*–77*d* (which are substantially the same). Reason: decreasing the width Wo of the outer most undulation 77*e* assures that the circumferential edge 73 are at a position adjacent of weighted chain 21 so folding of the cover 70 inward from the edge 77 toward the axis of symmetry 80 is retarded. The weighted chain 81 is seen to end in region 83 adjacent to hem 84, a part of which includes the circumferential edge 73 previously mentioned. Diagonally opposite to the region 83 is a identification tag 85 attached to the top surface 76. The tag 85 provides space wherein various information in written form may be attached and made a permanent part of the cover 70. Such information can include operational limitations related to use of the cover 70**, owner's name and address, etc.

A strap 86 is shown attached to the top surface 76 of the cover 70 at the center thereof. The strap 86 is rectangularly shaped and includes ends 87 that sewn to the top surface 76 in a position that the axis of symmetry 80 bisects the strap 86.

METHOD OF INSTALLATION

Referring to FIGS. 1 and 6, fitting the cover 10, 70 of the invention about the drain 11, 71 is straight-forward and generally takes only seconds for a person to manipulate the cover 10, 70 via the strap 30, 86, respectively, to cover the drain 11, 71. Care must be taken so that at least 10 inches of undulations 17, 77 (in the transverse and lateral directions relative to axis of symmetry 20, 80) are between the edge of the drain 11, 71 and the edge 13, 73 of the cover 10, 70.

Removal of the cover 10, 70 is equally easy. As the cover 10, 70 clears the drain 11, 71, the cover 10, 70 is easily folded back upon itself along either of the transverse and lateral directions and then transferred away from the job site. Owing to its weighted perimeter via the chain 21, 81, such cover 10, 70 can be easily refolded away from the job site to a small package and stowed.

Note also that full weight of the chains 21, 81 within each cover 10, 70 of the invention, is supported in its preferred rest position by the support structure adjacent to the drains 11, 71 over the full perimeter of the covers 10, 70 irrespective of the shape of such support upon which the covers 10, 70 rest. Inasmuch as the chain 21, 81 is formed of a high density metal such as lead, breaking the sealing pressure at its mating sealing surface as previously mentioned is difficult. That is, as previously stated the frictional force owing to the chain 21, 81 must be overcome by a sidewise- or vertically-directed exterior force. And if the force is the result of distributed pressure such as due to foot or a wheel, owing to the low profile of the hem 27, 84 such force is much reduced. But even if such force is sufficient and a portion of the hem 27, 84 rides up off its sealing contact, note that such action ultimately causes the full distributed weight of the chain 21, 81 to act downward and resist further movement.

FURTHER METHOD ASPECTS

In the manufacture of the covers 10, 70 of the invention, the sizes of drains and vents at several job sites are determined. Then a median value is established associated with providing at least a minimum transverse or lateral dimension wherein at least 10 inches of undulations 17, 77 exist between the edge of the drain or vent opening and the edge 13, 73 of the cover 10, 70. In that way, a variety of uses can be accommodated by a single manufactured cover. The manufacture is easily accomplished due to the fact that the weighted chain 21, 81 can be inserted interior of the cover 10, 70 as previously described. Sewing starts near the center of the assembly and proceeds outward in the series of loops as previously described. That is, after cutting of the top, intermediate and bottom sheets in rectangular or circular pieces and assembling the chain 21, 81 between the former two plys, these elements are sewn together in rectangular or circular loops of increasing lateral and transverse extent.

The above description contains several specific embodiments of the invention. It is not intended that such be construed as limitations on the scope of the invention, but merely as examples of preferred embodiments. Persons skilled in the art can envision other obvious possible variations within the scope of the description. Hence the scope of the invention is to be determined by the appended claims and their legal equivalents.

What is claimed is:

1. A device for providing a temporary cover for drains, vents of the like of a water drainage system of a refinery that may be contaminated by hydrocarbon fuel wherein flame fronts generated exterior thereof are quenched prior to gaining entry into said drainage system, comprising a plurality of sheets of flame resistant and chemical resistant materials in broad surface contact defining coextensive top and bottom surfaces, said top and bottom surfaces each including a central section and an outer edge section in integral contact with said central section, said outer edge sections composed of said top and bottom surfaces, being attached together in a series of undulations that occur on said and bottom surfaces, terminating at a perimetric continuous edge wherein said series of undulations are separated in a radial direction measured from said central section, said undulations having a common longitudinal axis of symmetry extending around said central section between a near end adjacent to said central section and remote end adjacent to said perimetric edge, weighted chain means having a longitudinal axis of symmetry, said weighted chain means adapted to be positioned relative to an associated horizontal, slightly curved irregular attaching surface of said drainage system and being inserted within said series of undulations wherein said longitudinal axis of symmetry of said weighted chain means is adapted to be substantially parallel with said associated horizontal, slightly curved irregular attaching surface and collinear of said longitudinal axis of symmetry of said series of undulations so as to add loft and weight as a function of radial extent relative to said central section whereby contact of said bottom surface relative to said associated horizontal, slightly curved irregular attaching surface is surprisingly strong and flame retardant wherein flame fronts generated exterior of said perimetric edge of said outer edge sections are quenched whether traveling radially across said series of undulations or along a continuous path parallelling said common longitudinal axis of symmetry of said undulations, said continuous path also permitting water to seep from exterior of said perimetric edge to said central section.

2. The device of claim 1 in which said plurality of sheets of flame resistant and chemically resistant materials are three in number and includes a top sheet, a bottom sheet and an intermediate sheet, said sheets being of similar size and shape.

3. The device of claim 2 in which said top and bottom sheets are each formed of a fire and chemically resistent polymer.

4. The device of claim 2 in which said intermediate sheet is composed of fiberglass fibers interwoven into a mat for the purpose of interposing a barrier for catching weld slag falling thereon.

5. The device of claim 1 in which said series of undulations are each provided by side-by-side seams parallel of said common longitudinal axis of symmetry of said undulations and extending through said top and bottom surfaces about said weighted chain means whereby valley and peak portions are defined along said top surface and along said bottom surface, said valley portions along said bottom surface defining said continuous path parallel to said common longitudinal axis of symmetry of said undulations, said continuous path permitting said water to seep from exterior of said perimetric edge to said central section.

6. The device of claim 5 in which said perimetric edge of said outer edge sections includes a terminating sewn hem therealong.

7. The device of claim 6 in which said perimetric edge is rectangularly shaped in plan view and in which said undulations along said top and bottom sheets are also rectangularly shaped in plan view wherein said weighted chain means rectangularly serpentines about said outer edge section relative to said central section.

8. The device of claim 6 in which said perimetric edge is circularly shaped in plan view and in which said undulations along said top and bottom sheets are also circularly shaped in plan view wherein said weighted chain means circularly spirals about said outer edge section relative to said central section.

9. The device of claim 1 in which said weighted chain means comprises a series of cylindrical links and a cable centrally attached to said series of cylinders, said links being formed of a high density metal.

10. A device for providing a temporary cover for drains, vents or the like, comprising a plurality of sheets of flame resistant and chemical resistant materials in broad surface contact defining coextensive top and bottom surfaces, said top and bottom surfaces each including a central section and an outer edge section in integral contact with said central section, said outer edge sections composed of said top and bottom surfaces, together defining a series of undulations therebetween, weighted chain means having a common longitudinal axis of symmetry and being inserted within said series of undulations symmetrically positioned around said central section so as to add loft and weight as a function of radial extent relative to said central section whereby contact of said bottom surface relative to an associated horizontal, slightly curved irregular attaching surface of a drainage system is surprisingly strong and flame retardant, said plurality of sheets of flame resistant and chemically resistant materials being three in number and including a top sheet, a bottom sheet and an intermediate sheet, said sheets being of similar size and shape, said top and bottom sheets each being formed of a fire and chemically resistant polymer, said polymer being formed of resins of polypropylene and vinyl in combination with a halogen to increase flame and chemical retardancy.

11. In a device for providing a temporary cover for drains, vents or the like of a water drainage system of a refinery that may be contaminated by hydrocarbon fuel wherein flame fronts generated exterior thereof are quenched prior to gaining entry into said drainage system, the combination comprising a drain opening of a water drainage system of a refinery, said drain opening being surrounded by a framing surface of horizontal, slightly curved irregular shape, a plurality of sheets of flame resistant and chemical resistant materials in broad surface contact defining coextensive top and bottom surfaces, said top and bottom surfaces each including a central section and an outer edge section in integral contact with said central section, said outer edge sections composed of said top and bottom surfaces, being attached together in a series of undulations that occur on said top and bottom surfaces, terminating at a perimetric continuous edge wherein said series of undulations are separated in a radial direction measured from said central section, said undulations having a common longitudinal axis of symmetry extending around said central section between a near end adjacent to said central section and a remote end adjacent to said perimetric edge, weighted chain means having a longitudinal axis of symmetry, said weighted chain means being positioned relative to said associated horizontal, slightly curved irregular attaching surface within said series of undulations wherein said longitudinal axis of symmetry is substantially parallel with said associated horizontal, slightly curved irregular attaching surface and substantially collinear of said longitudinal axis of symmetry of said series of undulations so as to add loft and weight as a function of radial extent relative to said central section whereby sealing pressure of said bottom surface relative to said framing surface of horizontal, slightly curved irregular shape about said drain opening, is surprisingly strong and flame retardant wherein flame fronts generated exterior of said perimetric edge of said outer edge sections are quenched whether traveling radially across said series of undulations or along a continuous path parallelling said common longitudinal axis of symmetry, said continuous path also permitting water to seep from exterior of said perimetric edge to said central section and is collected by said drain opening.

12. The combination of claim 11 in which said plurality of sheets of flame resistant and chemically resistant materials are three in number and includes a top sheet, a bottom sheet and an intermediate sheet.

13. The combination of claim 12 in which said top and bottom sheets are each formed of a fire and chemically resistent polymer.

14. The combination of claim 13 in which said intermediate sheet is fiberglass fibers interwoven into a mat for the purpose of forming a barrier for catching weld slag.

15. The combination of claim 11 in which said series of undulations are each provided by side-by-side seams parallel of said common longitudinal axis of symmetry of said undulations and extending through said top and bottom surfaces about said weighted chain means whereby valley and peak portions are defined along said top surface and along said bottom surface wherein said peak portions of said bottom surface contact said framing surface about said drain opening, said valley portions along said bottom surface defining said continuous path parallel to said common longitudinal axis of symmetry of said undulations, said continuous path permitting said water to seep from exterior of said perimetric edge to said central section.

16. The combination of claim 15 in which said undulations along said top and bottom sheets are rectangularly shaped in plan view wherein said weighted chain means rectangularly serpentines about said outer edge section relative to said central section.

17. The combination of claim 16 in which said plurality of sheets are also rectangularly shaped in plan view.

18. The combination of claim 11 in which said plurality of sheets are circular in plan view and in which said undulations along said top and bottom sheets are also circularly shaped in plan view wherein said weighted chain means circularly spirals within said outer edge section relative to said central section.

19. The combination of claim 11 in which said weighted chain means comprises a series of cylindrical links and a cable centrally attached to said series of cylinders, said links being formed of a high density metal.

20. In a device for providing a temporary cover for drains, vents or the like, the combination comprising a drain opening surrounded by a framing surface of horizontal, slightly curved irregular shape, a plurality of sheets of flame resistant and chemical resistant materials in broad surface contact defining coextensive top and bottom surfaces, said top and bottom surfaces each including a central section and an outer edge section in integral contact with said central section, said outer edge sections composed of said top and bottom surfaces, together defining a series of undulations therebetween, weighted chain means having a common longitudinal axis of symmetry and being inserted within said series of undulations symmetrically positioned around said central section so as to add loft and weight as a function of radial extent relative to said central section whereby sealing pressure of said bottom surface relative to said framing surface of horizontal, slightly curved irregular shape about said drain opening, is surprisingly strong and flame retardant, said plurality of sheets of flame resistant and chemically resistant materials being three in number and including a top sheet, a bottom sheet and an intermediate sheet, said top and bottom sheets each being formed of a fire and chemically resistant polymer, said polymer being formed of resins of polypropylene and vinyl in combination with a halogen to increase flame and chemical retardancy.

* * * * *